US006583585B2

(12) United States Patent
Takeda et al.

(10) Patent No.: US 6,583,585 B2
(45) Date of Patent: Jun. 24, 2003

(54) DISCHARGE LAMP LIGHTING CIRCUIT

(75) Inventors: Hitoshi Takeda, Shizuoka (JP); Toru Nakayama, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/010,458

(22) Filed: Dec. 6, 2001

(65) Prior Publication Data

US 2002/0089294 A1 Jul. 11, 2002

(30) Foreign Application Priority Data

Dec. 26, 2000 (JP) ..... 2000-394744

(51) Int. Cl.[7] ..... H05B 37/00
(52) U.S. Cl. ..... 315/291; 315/119
(58) Field of Search ..... 315/291, 119, 315/127, 225, 123, 128, 120, 125, 224, 209 R, 226, 76, 77, 82

(56) References Cited

U.S. PATENT DOCUMENTS 4,101,809 A * 7/1978 Morais ..... 315/156
4,162,429 A * 7/1979 Elms et al. ..... 315/284
4,870,327 A * 9/1989 Jorgensen ..... 315/307
5,925,983 A 7/1999 Toda et al. ..... 315/119
5,936,361 A 8/1999 Yamashita et al. ..... 315/308
6,066,921 A 5/2000 Nakamura et al. ..... 315/71
6,089,887 A 7/2000 Ozaki ..... 439/139

FOREIGN PATENT DOCUMENTS

EP 0 878 982 A2 11/1998
WO WO 98/38708 9/1998

* cited by examiner

*Primary Examiner*—James Clinger
(74) *Attorney, Agent, or Firm*—Fish & Richardson PC

(57) ABSTRACT

In a lighting circuit, a lighting control circuit of a discharge lamp and a starting circuit for supplying a starting pulse to the discharge lamp are provided and also, electric power and the starting pulse are supplied through a socket connected to the discharge lamp. The starting circuit provided within the socket has a transformer, a capacitor connected to a primary winding of the transformer and a self-breakdown type switch element. It is constructed so that a feeding path to the capacitor is formed to charge the capacitor only when the discharge lamp is connected to the socket and a connection between a first terminal and a third terminal is made.

4 Claims, 5 Drawing Sheets

DISCHARGE LAMP LIGHTING CIRCUIT

BACKGROUND OF THE INVENTION

The present invention relates to a technique for preventing a starting pulse from being supplied to a discharge lamp in a state in which the discharge lamp is not surely connected to a socket and also simplifying a circuit configuration therefor.

Recently, a small-size discharge lamp (metal halide lamp etc.) has received attention as a light source substituting for an incandescent lamp and, for example, as a configuration of a lighting circuit in the case of being applied to a light source of a lamp for vehicle, the lighting circuit comprising a DC power source, a power source part (switching power source circuit), a DC-AC conversion circuit and a starting circuit has been known.

On starting a discharge lamp, a starter transformer is required as a circuit for generating a starting pulse with high voltage, and a primary side circuit including a primary winding of the transformer is provided with a capacitor for accumulating an electric charge and a switch element for discharging this electric charge. Incidentally, as the switch element, a separately excited type configuration for receiving a signal from another circuit to control the conduction timing as a thyristor element and a self-excited type configuration for conducting at the time when a voltage across an element becomes a defined value as typified by a self-breakdown type element such as a spark gap element have been known.

By the way, with regard to selection of any of the two kinds of the switch elements, it is related to a form of a lighting control circuit (ballast circuit) and a starting circuit (starter circuit) of the discharge lamp. For example, when both the circuits are mounted on the same circuit board without a cord and are housed in one case, any of the two kinds of the switch elements may be used, but when both the circuits are arranged at a distant place and are wired by a cord, the self-excited type configuration becomes advantageous. The reason is because in the separately excited type configuration, disturbance noise is superimposed on a control signal for turning on or off the switch element and a malfunction of the switch element is feared. Also, with regard to wiring, in the separately excited type configuration, a signal line is required for electric charge supply of a primary side capacitor and control of a switch element in addition to two power supply lines.

In recent years, miniaturization of starter circuit components has developed and, for example, a form of integrating the starter circuit with the discharge lamp or a form of holding the starter circuit within a valve socket for discharge lamp connection has been used in application to a discharge lamp for vehicle. That is, the starter circuit tends to be arranged immediately near to the discharge lamp and be located at a place distant from the ballast circuit and thus, the self-excited type configuration using the self-breakdown type element is in the mainstream and there is no trouble of a malfunction and also, there is a cost merit in which two wirings of connection between the ballast circuit and the starter circuit will do.

FIG. 7 shows only the main part in a conventional configuration example, and shows a configuration of an output stage of a ballast circuit of a lighting circuit A and a starter circuit.

In a transformer C constructing a starter circuit B, one end of a secondary winding c2 of the transformer is connected to a power supply terminal ta1 and the other end is connected to an output terminal to. Also, in a primary winding c1 of the transformer C, one end of the primary winding is connected to an electric charge supply source D within a ballast circuit and a spark gap element E is connected to the other end side which is connected to the electric charge supply source d through the element. Incidentally, a capacitor F is interposed between connection terminals of a primary side circuit of the transformer C and the electric charge supply source D.

The other terminal ta2 of a pair of power supply terminals ta1, ta2 is connected to an output terminal to' and connections between the terminal and the output terminal to and a discharge lamp G are made through a connecting member H such as a socket (for example, a base part of the discharge lamp is fitted and coupled to the socket and each the terminal to, to' is individually connected to each electrode terminal of the discharge lamp G, respectively).

The present circuit is formed into a configuration of a four-terminal connection in the case of electrical connections between the ballast circuit and the starter circuit, but as a circuit in which this is formed into a configuration of a three-terminal connection, a configuration example shown in FIG. 8 is given.

In a lighting circuit A', one end of a primary winding c1 of a transformer C and one end of a secondary winding c2 are connected to a power supply terminal ta1 and also are connected to one end of a capacitor F. As a result of this, connection terminals of a ballast circuit and a starting circuit B can be reduced by one (incidentally, in the present example, a reference potential of an electric charge supply source D is grounded, but the grounding may be performed anywhere as long as a feeding path to the capacitor F can be formed).

By the way, since a starting pulse supplied to a discharge lamp is a high voltage, it is necessary to take measures against the case of turning on a lighting switch in a state in which the discharge lamp is not connected to a lighting circuit. This is because, for example, a breakdown may be caused when a high voltage is applied to a connection terminal within a valve socket and this state is left for a long time, or an operator may accidentally touch a connection terminal of a socket to trigger an electric shock accident when replacement operations of the discharge lamp are performed with forgetting that there is in a state of turning on the lighting switch.

Hence, there is considered a method constructed so that a feeding path for accumulating an electric charge in a capacitor within a starter circuit is formed when a discharge lamp has been connected using high voltage connection means (a valve socket etc.) and the feeding path is not formed when the discharge lamp has been disconnected from the high voltage connection means.

FIG. 9 and FIG. 10 show a main part of such a configuration example, and both the figures are based on the circuit example of FIG. 8.

Differences between a circuit example I shown in FIG. 9 and the circuit of FIG. 8 in the configuration are as follows.

A valve socket J is interposed between a lighting circuit and a discharge lamp G, and three terminals k1, k2, k3 are provided within the socket J.

Three terminals g1, g2, g3 are provided in a connection part (base part) of the discharge lamp G to the valve socket J, and the terminals g1, g2 of the three terminals are respectively connected to each electrode terminal of the discharge lamp G and the terminal g3 is connected to the terminal g2.

In a state in which the discharge lamp G is connected to the valve socket J, the terminal g1 is connected to the terminal k1 and the terminal k2 is connected to the terminal g2.

With respect to an electric charge supply source D, one end of the electric charge supply source D is connected to a connection point of a spark gap element E and a capacitor F and the other end is connected to the terminal k3.

In a state in which the discharge lamp G is connected to the valve socket J, the terminal k2 is connected to the terminal k3 and both the terminals are connected to a power supply terminal ta2.

Thus, in the present circuit I, when the discharge lamp G is disconnected from the valve socket J and the terminals k2 and k3 become a non-connection state, a feeding path to the capacitor F is not formed, so that generation of a starting pulse is prohibited.

Also, differences between a circuit example L shown in FIG. 10 and the circuit of FIG. 8 in the configuration are as follows.

A valve socket m is interposed between a lighting circuit and a discharge lamp G, and four terminals n1, n2, n3, n4 are provided within the socket M.

Four terminals g1, g2, g3, g4 are provided in a base part connected to the valve socket M of the discharge lamp G, and the terminals g1, g2 of the four terminals are respectively connected to each electrode terminal of the discharge lamp G and the terminal g3 is connected to the terminal g4.

In a state in which the discharge lamp G is connected to the valve socket M, the terminal n1 is connected to the terminal g1 and the terminal n2 is connected to the terminal g2 of the discharge lamp G.

The terminal n4 is connected to a connection point of a capacitor F and a spark gap element E.

The terminal n3 is connected to one end of an electric charge supply source D.

In a state in which the discharge lamp G is connected to the valve socket M, the terminal n3 is connected to the terminal g3 and the terminal n4 is connected to the terminal g4.

Thus, in the present circuit 1, when the discharge lamp G is disconnected from the valve socket M and the terminal n3 and the terminal n4 become a non-connection state, a feeding path to the capacitor F is not formed, so that generation of a starting pulse is prohibited.

However, with respect to the configurations of FIGS. 9 and 10, the following problems remain.

Though it is hard formed into a configuration of a three-terminal connection as the configuration shown in FIG. 8, a portion between a ballast circuit and a starter circuit returns to a four-terminal connection in FIG. 9.

In FIG. 10, it is necessary to increase connection terminals for connecting the discharge lamp G to the valve socket M by one to four, so that a design modification is forcedly made to a socket structure (at present, a three-terminal connection) and also there arise disadvantages in cost or safety.

SUMMARY OF THE INVENTION

An object of the invention is to reduce cost and improve safety by decreasing the number of connection wirings among a lighting control circuit, a starting circuit and a discharge lamp in a lighting circuit constructed so that a starting pulse is not generated in a state in which a discharge lamp is not connected to a socket.

In order to solve the problem described above, the invention comprises the following configurations in a discharge lamp lighting circuit comprising a lighting control circuit for performing lighting control of a discharge lamp, a starting circuit for supplying a starting pulse to the discharge lamp, and a socket connected to said discharge lamp in order to supply electric power and the starting pulse to the discharge lamp.

The starting circuit provided within the socket has a transformer, a capacitor connected to a primary winding of said transformer and a self-breakdown type switch element, and a feeding output terminal for performing a feeding from the lighting control circuit to the starting circuit is connected to the capacitor directly or through the primary winding and also an accumulation electric charge of said capacitor is discharged through the primary winding of the transformer by conduction of the self-breakdown type switch element and thereby the starting pulse is generated and said pulse is supplied to the discharge lamp through a secondary winding of the transformer.

First and second terminals of three terminals provided in the socket are respectively connected to each electrode terminal of the discharge lamp and also the second terminal is connected to the secondary winding of the transformer and a third terminal is connected to the capacitor of the starting circuit directly or through the primary winding.

A connection between the lighting control circuit and the starting circuit is made by a cord wire.

With respect to a pair of output terminals of the lighting control circuit, one output terminal is connected to the second terminal through the secondary winding of the transformer and the other output terminal is connected to the first terminal.

It is constructed so that a feeding path to the capacitor is formed through the feeding output terminal to charge said capacitor only when the discharge lamp is connected to the socket and a connection between the first terminal and the third terminal is made.

According to the invention, when the discharge lamp is not connected to the socket in a complete state and a connection between the first and third terminals is not made, the feeding path to the capacitor is not closed in the starting circuit, so that the starting pulse is not supplied to the discharge lamp. Then, a connection can be made by three terminals among the lighting control circuit, the starting circuit and the discharge lamp.

DETAILED DESCRIPTION OF THE PREFERRED EMBODIMENTS

Figure 1:
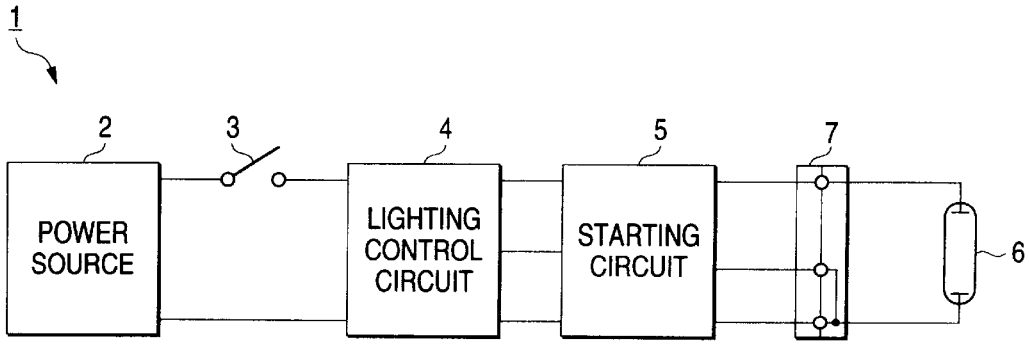
FIG. 1 is a circuit block diagram showing a basic configuration of the invention.

FIG. 1 is a diagram illustrating a basic configuration of a discharge lamp lighting circuit according to the invention.

In a discharge lamp lighting circuit 1, a power source is supplied from a power source 2 to a lighting control circuit (so-called ballast circuit) 4 through a lighting switch 3. As the lighting control circuit 4, for example, the circuit comprising a power source part of a switching regulator configuration and a DC-AC conversion circuit of a bridge type configuration is known, but as long as it is related to the invention, it does not matter how to perform lighting control of a discharge lamp.

A starting circuit (starter circuit) 5 arranged in a back stage of the lighting control circuit 4 is a circuit for supplying a starting pulse to a discharge lamp 6, and sends out the starting pulse to the discharge lamp 6 with the starting pulse superimposed on an output of the lighting control circuit 4.

A socket 7 is used in a connection between the discharge lamp 6 and its lighting circuit apparatus, and by inserting a base part of the discharge lamp 6 into a connection part of the socket 7 corresponding to this base part, both of the parts are coupled. That is, electric power or the starting pulse is supplied to the discharge lamp 6 surely connected to the socket 7. Incidentally, the socket 7 and the starting circuit 5 are shown in a positionally distant state, but it is formed into a configuration in which the starting circuit 5 is built into the socket 7. The reason is because the starting circuit S and the discharge lamp 6 can be directly connected substantially at close range and thus an advantage that the need for a long cord is eliminated in order to supply the starting pulse to the discharge lamp after generating the starting pulse with high voltage can be obtained (safety can be improved by preventing unexpected circumstances such as a electric shock accident from occurring). Also, there are advantages that an influence on attenuation of the starting pulse decreases and lighting performance improves.

Since the starting circuit 5 is held within the socket 7 and is arranged near to the discharge lamp 6, wiring is carried out by a cord wire with regard to connections between the lighting control circuit 4 and the starting circuit 5.

Figure 2:
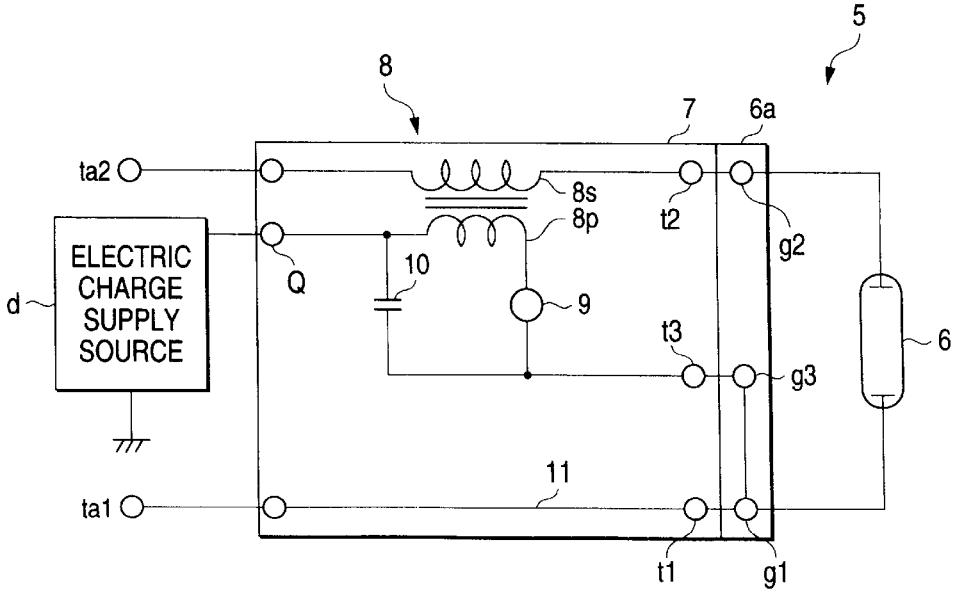
FIG. 2 is a diagram showing a configuration example of a main part according to the invention.

FIG. 2 shows a main part of a circuit configuration according to the invention, and shows a configuration of an output stage of the lighting control circuit 4 and the starting circuit 5 of the lighting circuit 1. Incidentally, with the starting circuit 5, a form of wiring this starting circuit 5 on a substrate to perform component mounting and a form of making connections between circuit components by a lead frame for forming a wiring path are given.

In the present example, in a transformer 8 constructing the starting circuit 5, one end of a secondary winding 8*s* of the transformer 8 is connected to a power supply terminal ta2 and the other end is connected to a terminal t2 within the socket 7.

The socket 7 constructs high voltage connection means for connecting the lighting circuit to the discharge lamp 6, and provides three terminals t1, t2, t3. Incidentally, terminals g1, g2, g3 respectively corresponding to each the terminal are provided in a connection part (base part) 6*a* to the socket 7 of the discharge lamp 6. That is, in a state in which the base part 6*a* of the discharge lamp 6 is surely connected to the socket 7, it is constructed so that the terminals t1, t2, t3 are respectively connected to the terminals g1, g2, g3. Also, the terminals g1 and g2 are terminals respectively connected to each electrode terminal of the discharge lamp 6, and the terminal g3 is connected to the terminal g1.

With a primary winding 8*p* of the transformer 8, one end of the primary winding 8*p* is connected to an electric charge supply source d within the lighting control circuit 4 and a self-breakdown type switch element (spark gap element etc.) 9 is connected to the other end side and the element is connected to the terminal t3 of the socket 7. Incidentally, a capacitor 10 is provided in parallel with respect to a series circuit consisting of the primary winding 8*p* and the self-breakdown type switch element 9, and one end of the capacitor 10 is connected to an output terminal Q (feeding output terminal) of the electric charge supply source d and the other end is connected to the self-breakdown type switch element 9 and the terminal t3. Incidentally, with the electric charge supply source d, for example, various forms such as a configuration obtained by rectifying and smoothing a secondary output of a step-up transformer provided within the lighting control circuit 4 or a configuration using things obtained by increasing an output voltage of the lighting control circuit 4 by several times using a voltage multiplying rectifier circuit have already been known, so that a description of the concrete configurations will be omitted.

A power supply terminal ta1 of a pair of power supply terminals ta2, ta1 is connected to the terminal t1 of the socket 7, and at the time of making a connection to the discharge lamp 6, it is constructed so as to being connected to the terminal g1.

In this manner, a configuration of the starting circuit 5 provided within the socket 7 has the transformer 8, the capacitor 10 connected to the primary winding 8*p* and the self-breakdown type switch element 9. Then, the feeding output terminal "Q" for performing a feeding from the lighting control circuit 4 to the starting circuit 5 is connected to these elements and also an accumulation electric charge of the capacitor 10 is discharged through the primary winding 8*p* of the transformer 8 by conduction of the self-breakdown type switch element 9 and thereby, a starting pulse is generated and this is supplied to the discharge lamp 6 through the secondary winding 8*s* of the transformer 8. Incidentally, when the first and second terminals (t1, t2) of the three terminals (t1 to t3) provided in the socket 7 are respectively connected to each electrode terminal of the discharge lamp 6, electric power is supplied to the discharge lamp 6.

Also, the second terminal t2 is connected to the secondary winding 8*s* of the transformer 8 and the third terminal t3 is connected to the capacitor 10 and the self-breakdown type switch element 9 of the starting circuit 5, so that the starting circuit 5 is closed in a state in which the terminal t1 is connected to the terminal g1 and the terminal t3 is connected to the terminal g3. That is, as shown in the drawing, the terminal g1 and the terminal g3 are made in a connection state in the base part 6*a*of the discharge lamp 6 and thus, in a state in which the discharge lamp 6 is surely connected to the socket 7, the terminal t1 is electrically connected to the terminal t3 and a feeding path to the capacitor 10 is formed, but in a state in which the discharge lamp 6 is disconnected from the socket 7 and the terminal t1 is not electrically connected to the terminal t3, the feeding path is not formed, so that generation of a starting pulse is prohibited.

Incidentally, with a pair of output terminals ta1, ta2 of the lighting control circuit 4, one output terminal ta2 is connected to the second terminal t2 through the secondary winding 8*s* of the transformer 8 and the other output terminal ta1 is connected to the first terminal t1, so that charging to the capacitor 10 is most performed in a polarity period of the output terminal in which a difference between the terminal Q and the terminal ta1 in electric potential becomes large.

In a configuration of FIG. 2, it is constructed so that a preventive function of prohibiting supply of the starting pulse to the discharge lamp operates always when a connection state between the discharge lamp 6 and the socket 7 is incomplete and the terminal t1 does not conduct to the terminal t3, but in some instances, such a function may be unnecessary (for example, cases that the number of man-hours is reduced or the same function can be implemented by another means).

Therefore, it is preferable that the preventive function can be freely selected by some setting operation.

Figure 3:
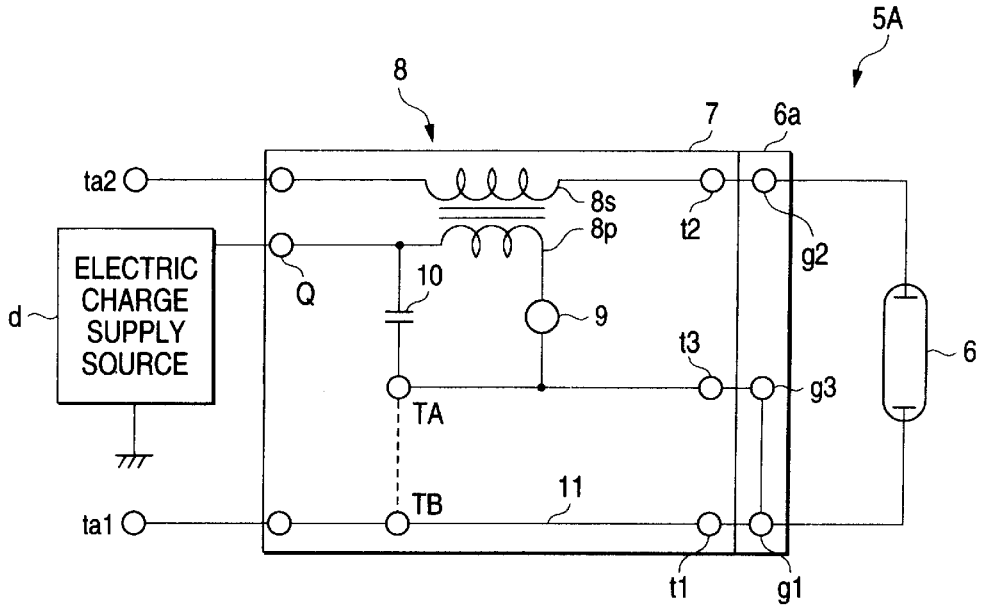
FIG. 3 is a diagram illustrating a terminal for setting for selecting the presence or absence of a preventive function of generation of a starting pulse.

In an example 5A shown in FIG. 3, it is constructed so that the function (the preventive function of generation of the starting pulse) can be selected by making settings whether or not a terminal "TA" for setting provided in one end (a terminal opposite to a connection end to an electric charge supply source d) of a capacitor 10 is connected to a terminal "TB" for setting provided on a connection line 11 for connecting a power supply terminal ta1 to a terminal t1 at the time of wiring.

That is, in a starting circuit 5A, it is constructed so that it can be selectively set whether or not the terminal t1 is connected to the terminal t3 and in the case of the setting that both the terminals are mutually connected, the terminal TA is connected to the terminal TB. As a result of this, the preventive function does not operate and a feeding path to the capacitor 10 of the starting circuit 5 is formed regardless of a connection state to the socket 7 of the discharge lamp 6. Also, in the case of the setting that the terminal TA is not connected to the terminal TB, the preventive function can be operated in a manner similar to the configuration of FIG. 2.

Figure 4:
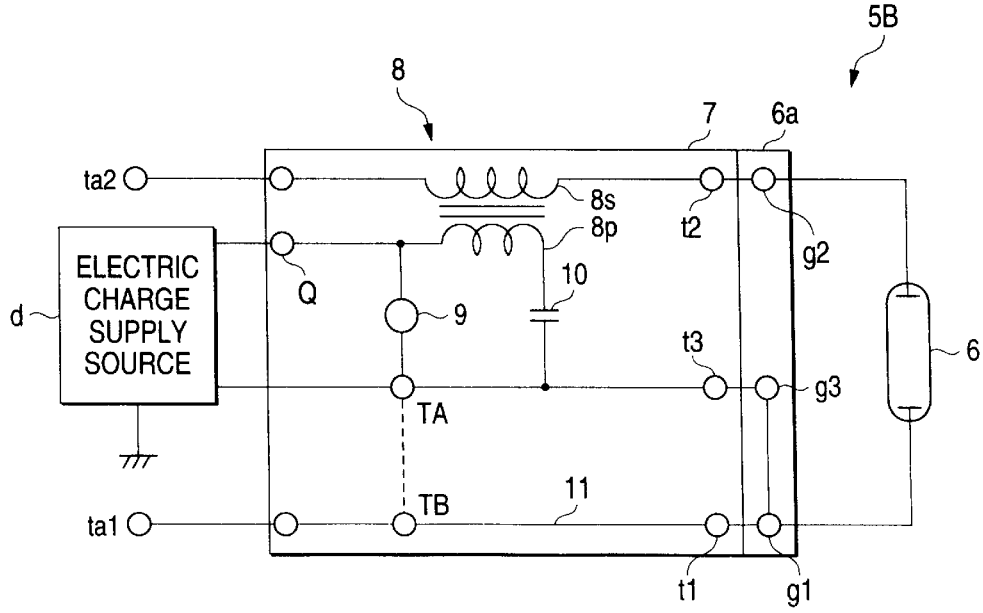
FIG. 4 is a diagram showing a modified example of FIG. 3.

In an example 5B shown in FIG. 4, a position relation between the capacitor 10 and the self-breakdown type switch element 9 in FIG. 3 is reversed, and a preventive function of generation of a starting pulse can be selected by making settings whether or not a terminal "TA" for setting provided in one end (a terminal opposite to a connection end to an electric charge supply source d) of the self-breakdown type switch element 9 is connected to a terminal "TB" for setting provided on a connection line 11 for connecting a power supply terminal ta1 to a terminal t1 at the time of wiring.

Figure 5:
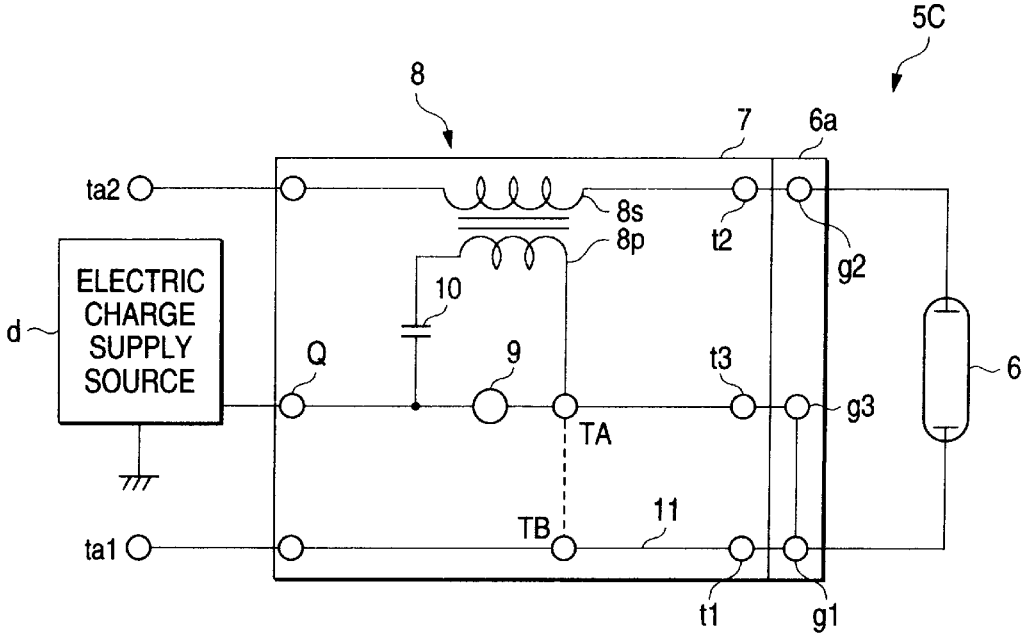
FIG. 5 is a diagram showing another configuration example.

Also, an example 5C shown in FIG. 5 is formed into a configuration in which one end of a primary winding 8*p* of a transformer 8 is connected to a feeding output terminal Q of an electric charge supply source d through a capacitor 10 and also the other end of the primary winding 8*p* is connected to a self-breakdown type switch element 9 and a third terminal t3, and a preventive function of generation of a starting pulse can be selected by making settings whether or not a terminal "TA" for setting provided in a connection point between the self-breakdown type switch element 9 and the primary winding 8*p* is connected to a terminal "TB" for setting provided on a connection line 11 for connecting a power supply terminal ta1 to a terminal t1 at the time of wiring.

Figure 6:
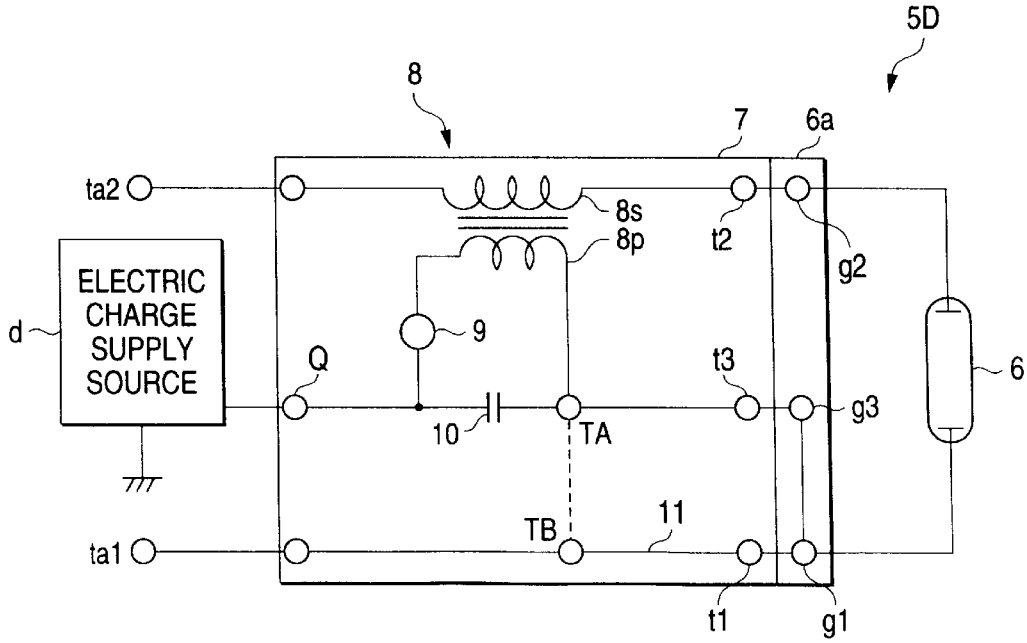
FIG. 6 is a diagram showing a modified example of FIG. 5.
Figure 7:
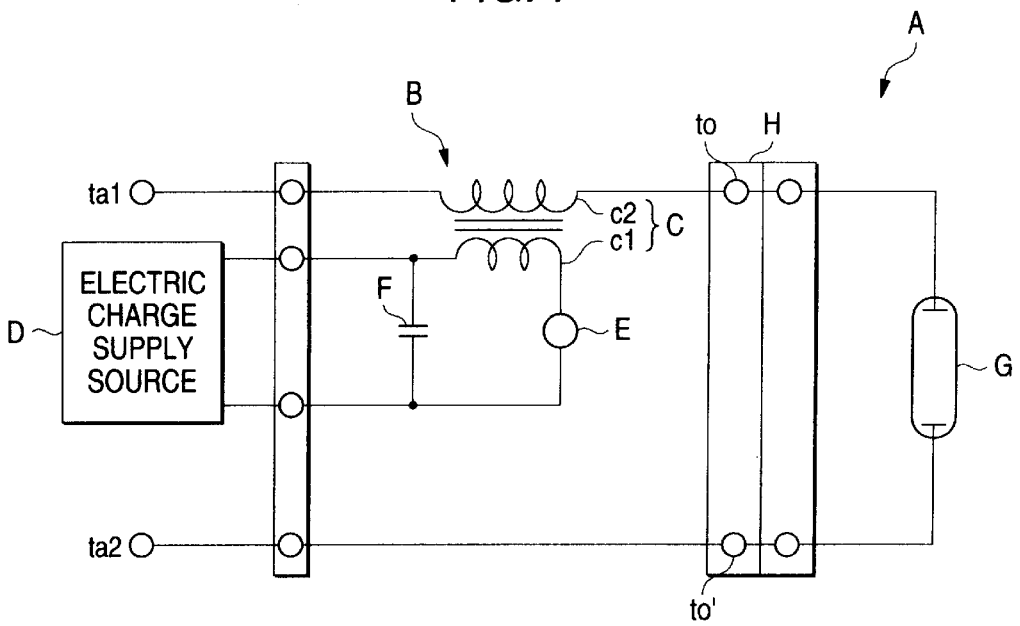
FIG. 7 shows a conventional configuration example along with FIGS. 8 to 10 and is a diagram showing a configuration of a four-terminal connection.
Figure 8:
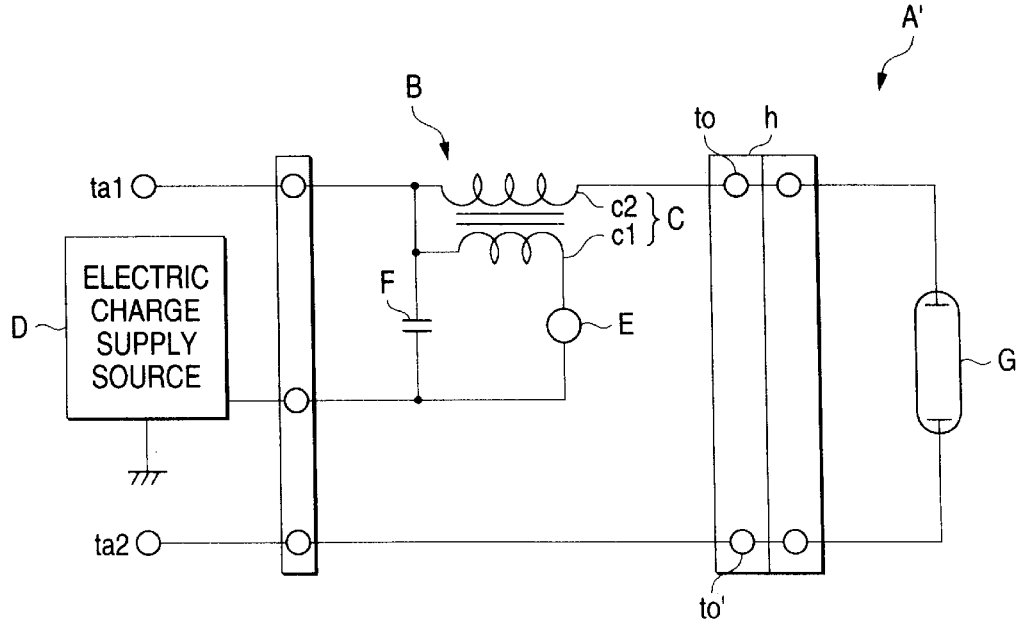
FIG. 8 is a diagram showing a configuration of a three-terminal connection.
Figure 9:
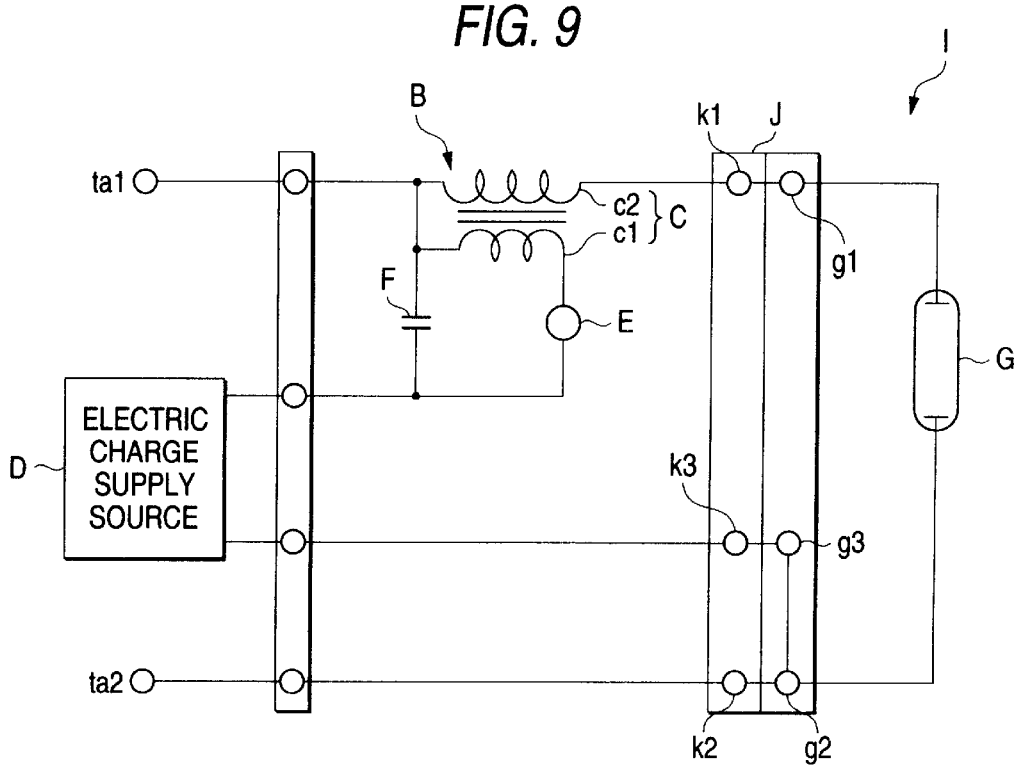
FIG. 9 shows a configuration example for providing a preventive function of generation of a starting pulse and is a diagram showing an example formed into a three-terminal connection in wiring within a socket.
Figure 10:
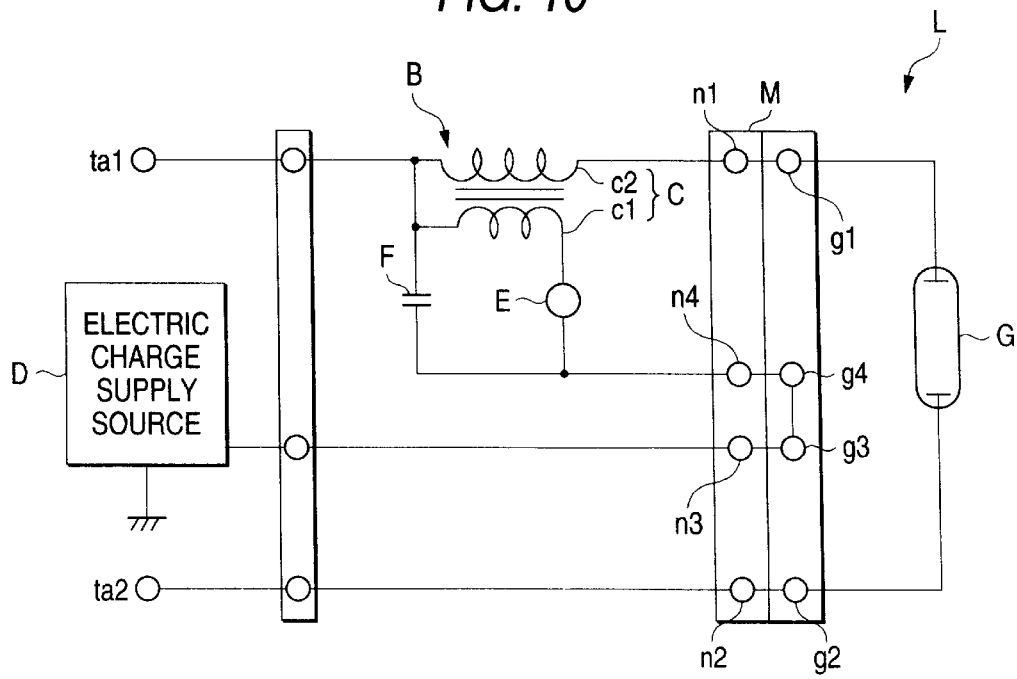
FIG. 10 is a diagram showing an example formed into a four-terminal connection in the wiring within the socket.

Incidentally, in an example 5D shown in FIG. 6, a position relation between the self-breakdown type switch element 9 and the capacitor 10 in the example 5C of FIG. 5 is reversed, and there is no difference in basic operations.

In a word, it may be constructed so that charging to the capacitor 10 provided in a primary side circuit of the transformer 8 can be performed and the capacitor 10 can be discharged through the primary winding 8*p* by conduction of the self-breakdown type switch element 9.

Incidentally, with settings of connection or non-connection between the terminal TA and the terminal TB, the following methods are given.

(1) A method of using a short bar or a resistor with 0 Ω

(2) A method of removing a terminal connecting member previously wired (3) A method by a bus bar (4) A method of providing a welding point First, in the method (1), there are manners in which when wiring of a starting circuit is processed on a substrate, it is constructed so as to be able to select whether or not terminals are mutually connected by a short bar, or selections of connection or non-connection of the mutual terminals according to whether or not a resistor with 0 ω (ohm) is mounted at the time of component mounting to the substrate are directed to mounting equipment.

In the method (2), it is constructed so that provision of the preventive function is selected by removing or blanking a cord or copper foil previously wired between both terminals, or the function is not selected by leaving the cord or copper foil as it is.

Incidentally, in accordance with the method (1) or (2), since there is no need to prepare two kinds of substrates according to the presence or absence of the function, there is no need to make two kinds of molds (data mask etc.) for substrate formation, so that production control becomes simple.

Also, the method (3) is a method of selecting the presence or absence of the function according to whether or not a wired bus bar is cut in the case of performing wiring of a starting circuit by a bus bar piece. For example, handling can be easily performed by a blanking cut through a cutter at the time of manufacturing the bus bar piece.

In the method (4), a point for welding is provided for connection between both terminals and the presence or absence of the function may be selected according to whether or not a short bar is welded.

Since any of the methods can be performed by relatively simple processing, a problem in cost hardly arises. That is, it can be reduced to sufficiently low cost as compared with the fact that two kinds of necessary components such as substrates are prepared and controlled according to whether or not the function is used. Also, by previously defining a connection state of both terminals according to specifications of the majority with the presence or absence of the preventive function, processing on the specifications of thees majority is unnecessary and processing on only the specifications of the minority may be performed.

Incidentally, with connection or non-connection between both terminals, a method suitable for a visual check or a check operation by image processing is preferable.

As is evident from the contents described above, according to the invention as defined in claim 1, when a discharge lamp is not connected to a socket in a complete state and a connection between first and third terminals is not made, a feeding path to a capacitor is not closed in a starting circuit, so that a starting pulse is not supplied to the discharge lamp. Therefore, bad effects (a breakdown or a trigger of an electric shock accident) of the case of operating a lighting circuit in an incomplete connection state of the discharge lamp and the lighting circuit can be prevented beforehand. Then, three-terminal connection wiring will do among a lighting control circuit, the starting circuit and the discharge lamp, so that there arise advantages in cost or safety.

According to the invention as defined in claim 2, with regard to a protective function of causing supply of the starting pulse to the discharge lamp to be prohibited when a connection between the discharge lamp and the socket is incomplete, the presence or absence of settings of the protective function can be easily selected according to whether or not the a connection between both the first and third terminals is made.

According to the invention as defined in claim 3, it is constructed so that the feeding path to the capacitor of the starting circuit is formed regardless of a connection state to the socket of the discharge lamp only when a connection between both terminals for setting provided in the starting circuit is made and thereby, a circuit configuration becomes simple and the need to prepare circuit patterns or wiring patterns of plural kinds is eliminated.

What is claimed is:

1. A discharge lamp lighting circuit comprising:

a lighting control circuit having a pair of power output terminals, which performs lighting control of a discharge lamp;

a starting circuit including a transformer, a capacitor connected to a primary winding of said transformer and a self-breakdown type switch element, which supplies a starting pulse to the discharge lamp, a charge feeding output terminal being connected to said capacitor directly or through the primary winding, and an accumulation electric charge of said capacitor being discharged through the primary winding of the transformer by conduction of the self-breakdown type switch element and thereby the starting pulse is generated and said pulse is supplied to the discharge lamp through a secondary winding of the transformer; and a socket connected to said discharge lamp to supply electric power and the starting pulse to the discharge lamp, which accommodates said starting circuit therein, said socket including first, second and third terminals, the first terminal being connected to an end of the discharge lamp, the second terminal being connected to the other end of the discharge lamp and the secondary winding of the transformer and the third terminal being connected to the capacitor of the starting circuit directly or through the primary winding, wherein one power output terminal is connected to the second terminal through the secondary winding of the transformer and the other output terminal is connected to the first terminal, and a feeding path to the capacitor is formed through the charge feeding output terminal to charge said capacitor only when the discharge lamp is connected to the socket and a connection between the first terminal and the third terminal is made.

2. A discharge lamp lighting circuit as claimed in claim 1, wherein it is constructed so that it can be selectively set whether or not a connection between the first terminal and the third terminal is made and when the setting that both the terminals are mutually connected is made, it is constructed so that a feeding path to the capacitor of the starting circuit is formed regardless of a connection state to the socket of the discharge lamp.

3. A discharge lamp lighting circuit as defined in claim 2, wherein one end of the capacitor is connected to an electric charge supply source directly or through the primary winding of the transformer and also the other end of said capacitor is connected to the third terminal directly or through the primary winding of the transformer, and a terminal for setting connected to the third terminal and a terminal for setting connected to the first terminal are provided in the starting circuit and when both the terminals for setting are connected, it is constructed so that a feeding path to the capacitor of the starting circuit is formed regardless of a connection state to the socket of the discharge lamp.

4. A discharge lamp lighting circuit as defined in claim 1, a connection between the lighting control circuit and the starting circuit is made by a cord wire.

* * * * *